United States Patent [19]

Mattingly, Jr.

[11] 4,184,245

[45] Jan. 22, 1980

[54] REMOVAL TOOL AND METHOD OF USING

[75] Inventor: William R. Mattingly, Jr., Santa Ana, Calif.

[73] Assignee: Matrix Science Corporation, Torrance, Calif.

[21] Appl. No.: 938,586

[22] Filed: Aug. 31, 1978

[51] Int. Cl.[2] ..... H01R 43/00

[52] U.S. Cl. ..... 29/629; 29/235; 29/278; 29/427; 29/453; 29/764; 339/217 S

[58] Field of Search ..... 29/764, 629, 758, 426, 29/427, 278, 235, 453; 339/217 S

[56] References Cited

U.S. PATENT DOCUMENTS

| | | | |
|---|---|---|---|
| 3,110,093 | 11/1963 | Johnson | 29/764 X |
| 3,541,661 | 11/1970 | Nava | 29/764 X |
| 3,824,670 | 7/1974 | Clark | 29/758 X |

*Primary Examiner*—Carl E. Hall

*Attorney, Agent, or Firm*—Nilsson, Robbins, Dalgarn, Berliner, Carson & Wurst

[57] ABSTRACT

A removal tool having a tubular shape with a chamfered end and a method for utilizing the same in an electrical connector apparatus. The connector apparatus has a contact attached around and to the end of a wire. An elliptical rear edge of the contact has major axis edge portions which come in contact with an inside shoulder of an insulator body passageway preventing the contact from being removed rearwardly from the connector. The chamfered end of the removal tool is inserted between the wire and the inside elliptical surface to resiliently deform the ellipse to a circular or near circular shape so that it may be withdrawn through a rear passageway.

5 Claims, 4 Drawing Figures

REMOVAL TOOL AND METHOD OF USING

BACKGROUND OF THE INVENTION

The present invention relates to electrical connectors and, in particular, to removal tools for removing a contact retained in an insulation body by an elliptical retaining edge in contact with a circular inside insulator shoulder.

Various prior-art connector designs have been disclosed in my co-pending U.S. Patent Application Ser. No. 923,236, filed July 10, 1978, which itself is for a novel connector system. In conjunction with all connectors and connector systems having a plurality of electrical contact portions and a retaining insulator portion, it is desirable that each electrical contact portion be easily removable from the retaining insulator portion without damaging or having to provide an entirely new retaining insulator portion. The present invention discloses such a removal tool that allows each individual contact portion to be removed from the insulator portion through the rear of the connector rather than through the front of the connector as would be required, for example, with the connector assembly disclosed in U.S. Pat. No. 3,396,364.

SUMMARY OF THE INVENTION

The present invention comprises a removal tool for removing a contact, circumferentially attached to the end of a wire, from an insulator passageway. The insulator passageway defines an interior cylindrical passageway having a first diameter and a connecting cylindrical passageway having a second diameter where the first diameter is larger than the second diameter. The contact is provided with a retaining end having an elliptical cross section where the minor inside diameter of the elliptical cross section is at least as large as the diameter of the wire. The major outside diameter of the elliptical cross section of the retaining end is greater than the second diameter so that the contact is retained in the interior cylindrical passageway. The removal tool for removing a contact of the above configuration comprises a tube having a chamfered end where the tube is adapted for being slidably positioned around the wire with the chamfered end positioned for being inserted into the elliptical retaining end of the contact. The outside diameter of the tube is greater than the minor inside diameter of the elliptical cross section of the retaining end of the contact and smaller than the second diameter of the connecting passageway.

In one embodiment, the removal tool may additionally have a single longitudinal slot along its length whereby the tube may be removably positioned around the wire.

In yet another embodiment, the removal tool may have two longitudinal slits along its length whereby the removal tool may be removably positioned around the wire.

In the preferred embodiment of the removal tool, the outside diameter of the leading edge of the chamfered end is preferably at least as small as the minor diameter of the elliptical cross section of the retaining end of the contact.

A novel method of removing a contact, circumferentially attached to the end of a wire, from an insulator passageway may thus be provided where the insulator passageway defines an interior cylindrical passageway having a first diameter and a connecting cylindrical passageway having a second diameter, where the first diameter is larger than the second diameter. The contact further has a retaining end with an elliptical cross section where the minor inside diameter of the elliptical cross section is at least as large as the diameter of the wire and the major outside diameter of the elliptical cross section is greater than the second diameter whereby the contact is retained in the interior cylindrical passageway. The method of removing the contact as described comprises the steps of providing a removal tool having a tubular shape—the removal tool having a chamfered end, positioning the removal tool around the wire, inserting the chamfered end of the removal took into the retaining end of the contact between the wire and the inside surface of the retaining end for resiliently increasing the minor diameter and decreasing the major diameter until the major diameter and the minor diameter are simultaneously smaller than the second diameter and, finally, withdrawing the removal tool of the contact and the attached wire from the insulator passageway through the connecting cylindrical passageway having the second diameter.

BRIEF DESCRIPTION OF THE DRAWINGS

The invention will be better understood from the detailed description below taken in conjunction with the drawings wherein like reference characters refer to like parts throughout and in which.

DETAILED DESCRIPTION

Figure 1:
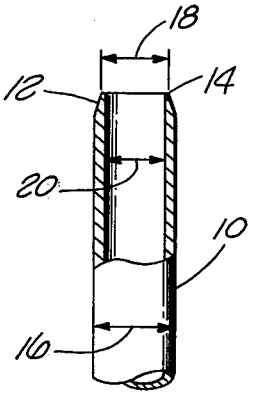
FIG. 1 is a plan view of the removal tool in accordance with the present invention.

Referring first to FIG. 1, the removal tool of the present invention for utilization in removing the clipless contact disclosed in U.S. Pat. Application Ser. No. 923,263, filed July 10, 1978, comprises a cylindrical tube 10 having a beveled or chamfered end 12 and a leading edge 14 of the chamfered end 12. As shown in FIG. 1, the removal tool of the present invention has a generally circular inside passageway having an inside diameter 20 and a generally cylindrical outside surface having an outside diameter 16. The minimum outside diameter 18 of the chamfered end 12 thus occurs at the leading edge 14 of the tube 10. The removal tool shown in FIG. 1 is particularly useful in removing an electrical contact, such as a pin contact or a socket contact, from an insulator, a detailed description of which has been shown in my co-pending application Ser. No. 923,263. By way of illustration, a representative pin contact as positioned in place in a passageway through an insulator is shown in FIG. 2.

Figure 2:
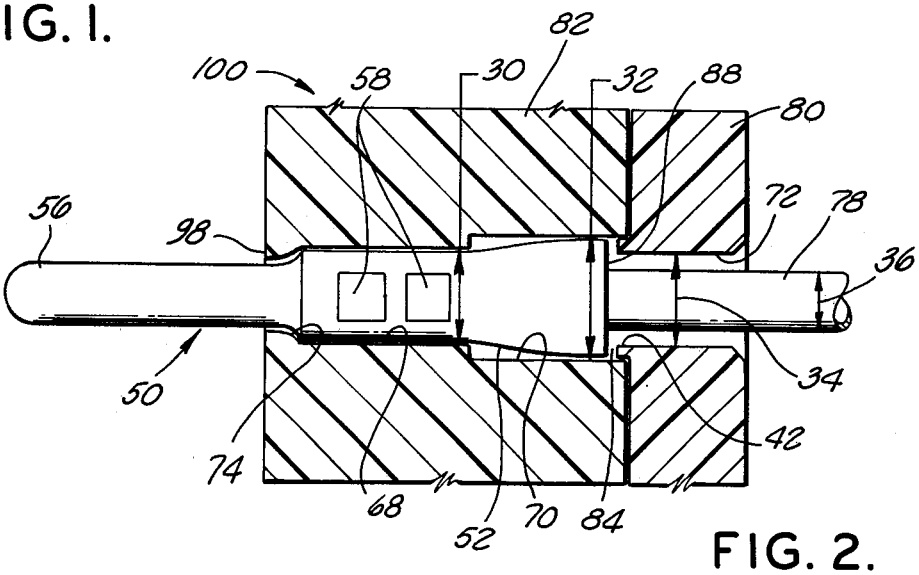
FIG. 2 is illustrative of a connector assembly having a contact which may be removed from an insulator portion by the removal tool of the present invention.

Referring to FIG. 2, a pin contact or member 50 having a pin portion 56 and an elliptical retaining portion 52 is shown in place in an insulator assembly 100 and comprises of a front pin insulator member 82 and a rear insulator member 80 which, when connected together, define a contact insertion passageway having a front passageway portion 68 with a front insulator passageway retaining shoulder 74 for preventing the contact member 50 from passing through the front of the contact insulator assembly. The pin insert passageway also comprises a front insulator retaining passageway 70. A rear insulator passageway portion 72 is provided through the rear insulator 80. The rear insulator 80 has a circular lip 42 which extends into the central retaining passageway portion 70 to define a circular retaining shoulder 84. A wire 78 is inserted into the pin contact 50 and is held in place by the crimps 58.

The contact 50 and insulation assembly 100 are assembled by inserting the pin engagement region 56 through the rear insulator passageway 72, the front insulator retaining passageway 70 and out through the front end 98 of the insulator assembly 100. As the pin portion of the contact is inserted, the retaining portion 52 enters the rear insulator passageway portion 72, the elliptical shape of the retaining portion 52 having a retaining edge 88, is resiliently deformed by the surface of the rear passageway portion 72 to assume a more circular cross section. When the retaining edge 88 passes the circular retaining shoulder 84, it again returns to an elliptical cross-sectional shape with the rear shoulder 84 preventing the contact 50 from thereafter being removed except with a removal tool.

Figure 3:
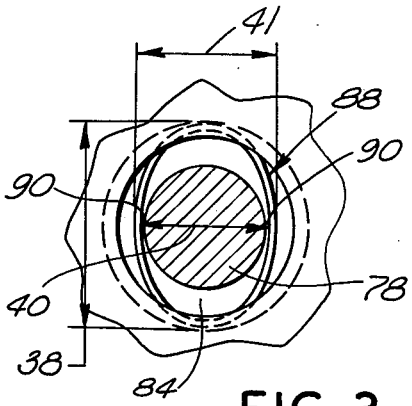
FIG. 3 is an end plan view as seen from the rear of the connector shown in FIG. 2.

Referring now to FIG. 3, the end of the connector assembly as viewed through the rear insulator 80 in FIG. 2, is shown illustrating the circular cross section of the wire 78 and the elliptical cross section of the retaining edge 88 around the wire 78. The elliptical cross section of the edge 88 is shown in position behind the circular retaining shoulder 84 which is perpendicular to and connects the front insulator retaining passageway 70 and the rear insulating passageway 72.

In FIG. 2, the relative dimensions of the various essential parts of the present invention are shown where the wire 78 has a wire diameter 36, the rear insulator passageway 72 has a diameter 34 larger than wire diameter 36, and the front insulator retaining passageway 70 has a diameter 32 which is larger than the rear insulator passageway diameter 34. Although not essential in the preferred embodiment, the retaining portion of the contact which includes the region where the crimps 58 are located, as well as the region where the elliptical cross section retaining portion 52 is located, is made from the same cylindrical tube into which the wire 78 is inserted. Thus, the region of the retaining portion at which the wire 78 is crimped by the crimps 58 is generally circular, having a diameter of 30.

Referring to FIG. 3, the elliptical cross section retaining portion 52 may be formed by pinching the end of the retaining portion so that the end assumes a permanently elliptical shape which is resiliently deformable to a circular shape having a diameter 30. Thus, as shown in FIG. 3, the retaining edge 88 of the contact 50 is elliptically shaped with the major outside diameter of the ellipse 38 and a minor inside diameter 40. In the preferred embodiment, the minor inside diameter 40 of the retaining edge 88 of the contact 50 is somewhat larger than the wire diameter 36 so that a small space 90 will exist on either one or both sides between the outside surface of the wire and the inside surface of the elliptically cross-sectioned retaining portion 52 at the retaining edge 88. This small space 90 is preferable so that the leading edge 14 of the removal tool may be inserted between the inside surface of the retaining portion of the contact 50 and the outside surface of the wire.

In addition, it is preferable that the outside diameter of the tube 10 (FIG. 1) comprising the removal tool, be such that when the removal tool is fully inserted into the rear portion of the contact 50 the elliptically cross-sectioned retaining portion 52 will be resiliently deformed so that the minor outside diameter and the major outside diameter will be approximately equal to the outside diameter 16 of the tube 10. Simultaneously, the major outside diameter 38 of the retaining edge 88 of the elliptically cross-sectioned retaining portion 52 will be decreased to a diameter less than the inside diameter 34 of the rear insulator passageway 72. Since the minor outside diameter 41 of the retaining edge 88 will also be less than the diameter 34 of the rear insulator passageway 72, the removal tool and the contact 50 will no longer be retained by the circular retaining shoulder 84 and may consequently be removed through the rear insulator passageway 72.

A significant advantage of the present invention is that, because the ellipitically cross-sectioned retaining portion 52 is resilient, when the removal tool is inserted into the interior of the elliptically cross-sectioned retaining portion 52, the inside surface opposite the minor diameter will press firmly against the outside of the tube 10, thus allowing the removal tool to be firmly held by the resiliently deformable, elliptically cross-sectioned retaining portion 52 so that the contact 50 will be withdrawn through the rear insulator passageway 72 at the same time that the removal tool is withdrawn therethrough. Of course, once the contact has been withdrawn from the insulator, the removal tool may be withdrawn from the space between the interior surface of the retaining portion and the outside surface of the wire 78 whereupon the retaining edge 88 will return to its elliptical shape.

In one embodiment of the present invention, the removal tool may be a tube such as the tube 10 in FIG. 1 which is unslit. A removal tool having this configuration may be permanently assembled to the wire 36 before crimping the contact onto the edge of the wire. Alternatively, the removal tool tube 10 may be slit along one side. By making the tube out of a resilient material, such as a soft plastic, the interior of the tube 10 may be exposed by separating the tube along the slit and then inserting the wire through the slit. The removal tool may then be slid along the wire for being inserted into the interior of the contact.

Figure 4:
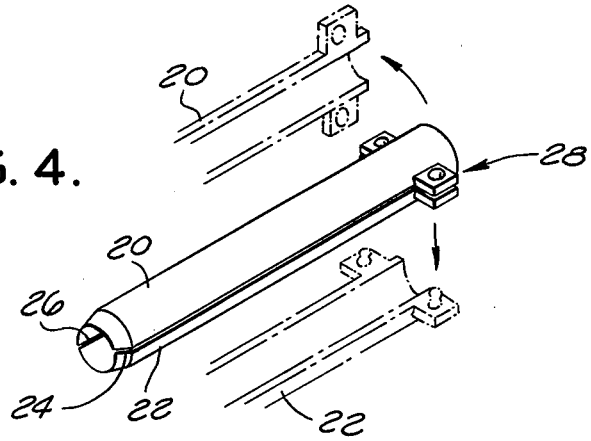
FIG. 4 is a pictorial plan view of one embodiment of the present invention showing a dual slit arrangement along the length of the removal tool.

In still another embodiment, such as that shown in FIG. 4, the removal tool may be split along two sides by a first slit 24 and a second slit 26. The removal tool then comprises a first tube half 20 and a second tube half 22 which may be coupled together by a snap or hinge connection 28 or any other suitable connection whereby the two halves 20 and 22 of the removal tool may be fitted around the wire and snapped in place. The removal tool may then be utilized in the manner previously described.

Of course, it will be appreciated that any number of slits may be provided in the removal tool but it will obviously be preferable to have no more than two oppositely positioned slits, such as that shown in FIG. 4.

In summary, therefore, the removal tool comprises a cylindrical, chamfered tube, which may be slit longitudinally. The removal tool is positioned around a wire to which a contact 50 is crimped by the crimps 58. The contact may be removed from the insulator by pushing the chamfered end of the removal tool along the wire to make entry into the insulator passageway of the connector. As the leading edge 14 of the removal tool enters the interior retaining passageway 70, the minor diameter of the elliptical retaining portion of the contact is increased by sliding up the chamfer of the removal tool until the retaining edge 88 of the contact 50 is circular or near circular in cross section. At this point, the wire and removal tool may be withdrawn with the contact 50 from the insulator passageway.

Although various specific details of the present invention have been illustrated, all such details and specifics are illustrative only and are not to be construed in a limiting sense.

I claim:

1. A removal tool for removing a contact, circumferentially attached to the end of a wire, from an insulator passageway defining an interior cylindrical passageway having a first diameter and a connecting cylindrical passageway having a second diameter, where the first diameter is larger than the second diameter, the contact having a retaining end with an elliptical cross section where the minor inside diameter of the elliptical cross section is at least as large as the diameter of the wire and the major outside diameter of the elliptical cross section is greater than the second diameter for retaining the contact in the interior cylindrical passageway, the removal tool comprising:

a tube having a chamfered end for being slidably positioned around the wire with the chamfered end positioned adjacent the retaining end of the contact for being inserted between the wire and the minor inside diameter of the retaining end of the contact, the outside diameter of the tube being greater than the minor inside diameter of the elliptical cross section of the retaining end of the contact and smaller than the second diameter.

2. The removal tool of claim 1, the tube having a single longitudinal slit along its length whereby the tube may be removably positioned around the wire.

3. The removal tool of claim 1, the tube having at least two longitudinal slits along its length whereby the tube may be removably positioned around the wire.

4. A removal tool for removing a contact, circumferentially attached to the end of a wire, from an insulator passageway defining an interior cylindrical passageway having a first diameter and a connecting cylindrical passageway having a second diameter, where the first diameter is larger than the second diameter, the contact having a retaining end with an elliptical cross section where the minor inside diameter of the elliptical cross section is at least as large as the diameter of the wire and the major outside diameter of the elliptical cross section is greater than the second diameter for retaining the contact in the interior cylindrical passageway, the removal tool comprising;

a tube having a chamfered end for being positioned around the wire with the chamfered end positioned adjacent the retaining end of the contact for being inserted between the wire and the minor inside diameter of the elliptical cross section of the retaining end of the contact for resiliently increasing the minor diameter and decreasing the major diameter until the major diameter and the minor diameter are simultaneously smaller than the second diameter.

5. A method for removing a contact, circumferentially attached to the end of a wire, from an insulator passageway defining an interior cylindrical passageway having a first diameter and a connecting cylindrical passageway having a second diameter, where the first diameter is larger than the second diameter, the contact having a retaining end with an elliptical cross section, the method comprising the steps of:

providing a removal tool having a tubular shape, the removal tool having a chamfered end;

positioning the removal tool around the wire;

inserting the chamfered end of the removal tool into the retaining end of the contact between the wire and the inside surface of the retaining end for resiliently increasing the minor diameter and decreasing the major diameter until the major diameter and the minor diameter are simultaneously smaller than the second diameter; and withdrawing the removal tool, the contact and the attached wire from the insulator cavity through the connecting cylindrical cavity.

* * * * *